United States Patent [19]

Orikasa

[11] Patent Number: 4,472,985

[45] Date of Patent: Sep. 25, 1984

[54] FASTENING TOOL

[75] Inventor: Hiroaki Orikasa, Katsuta, Japan

[73] Assignee: Hitachi Koki Company, Limited, Tokyo, Japan

[21] Appl. No.: 316,831

[22] Filed: Oct. 30, 1981

[30] Foreign Application Priority Data

Oct. 31, 1980 [JP] Japan ..... 55-154282

[51] Int. Cl.[3] ..... B25B 21/00

[52] U.S. Cl. ..... 81/56

[58] Field of Search ..... 81/55–56, 81/57.16–57.19, 57.22, 57.34, 57.36; 464/57, 61

[56] References Cited

U.S. PATENT DOCUMENTS 2,928,302 3/1960 Owen et al. ..... 81/56

3,002,594 10/1961 Haseler et al. ..... 464/57

*Primary Examiner*—Frederick R. Schmidt

*Assistant Examiner*—Debra S. Meislin

*Attorney, Agent, or Firm*—Lowe King Price & Becker

[57] ABSTRACT

A power-driven bolt fastening tool or shearing wrench includes an outer socket adapted to fit over the head of a bolt to be fastened and an inner socket disposed coaxially in the outer socket and adapted to fit over the tip of the bolt. A planetary gear mechanism comprises an internal gear coupled to the outer socket through a lost-motion connection, planet gears supported on shafts coupled to the inner socket, and a sun gear in mesh with the planet gears. The lost-motion connection comprises a torsion spring acting between the internal gear and the outer socket for allowing the internal gear to angularly move for a limited angular interval before the outer and inner sockets fit fully over the bolt head and tip and before a fastening torque is transmitted from the sun gear to the outer socket.

1 Claim, 3 Drawing Figures

FASTENING TOOL

BACKGROUND OF THE INVENTION

The present invention relates to a fastening tool, and more particularly to a torque transmitting mechanism in a power-driven fastening tool such as a shearing wrench having outer and inner sockets.

Conventional shearing wrenches for fastening torque-strength bolts include outer and inner sockets structured to fit over a head and a tip respectively on an end of the bolt to be tightened. When the wrench end rotates too fast or the outer or inner socket is brought toward the bolt too slowly, however, the outer or inner socket tends to remain out of full fitting engagement with the bolt head or tip. As the bolt is fastened, it produces reactive forces which act on the wrench to prevent the outer or inner socket from being completely fitted over the bolt head or tip even if the operator attempts to press the wrench against the bolt. A continued effort forcing the outer or inner socket against the bolt under this condition will likely deform the bolt head.

SUMMARY OF THE INVENTION

A bolt fastening tool of the invention includes a planetary gear mechanism having an internal gear to which an outer socket for fitting over the head of a bolt to be fastened is coupled through a lost-motion connection. The lost motion connection includes a torsion spring acting between the internal gear and the outer socket, and planet gears having shafts secured to an inner socket adapted to fit over the shearable tip of the bolt. The internal gear is permitted to move angularly with respect to the outer socket for a limited angular interval before a fastening torque is transmitted from the sun gear of the planetary gear mechanism to the outer socket, thus allowing the outer and inner sockets to fit completely over the bolt head and tip, respectively, before the bolt is fastened, and hence before the outer and inner sockets are subjected to reactive forces from the bolt.

It is an object of the present invention to provide a fastening tool which will eliminate the difficulties inherent in prior fastening tools.

Another object of the present invention is to provide a fastening tool which will allow outer and inner sockets to fit fully over the head and tip of a bolt before the latter is fastened.

Still another object of the present invention is to provide a power-driven fastening tool which can fasten bolts without causing damage.

BRIEF DESCRIPTION OF THE DRAWINGS

The above and other objects of the present invention will become more apparent from the following description when taken in conjunction with the accompanying drawings in which a preferred embodiment of the invention is shown by way of illustrative example.

DETAILED DESCRIPTION

Figure 1:
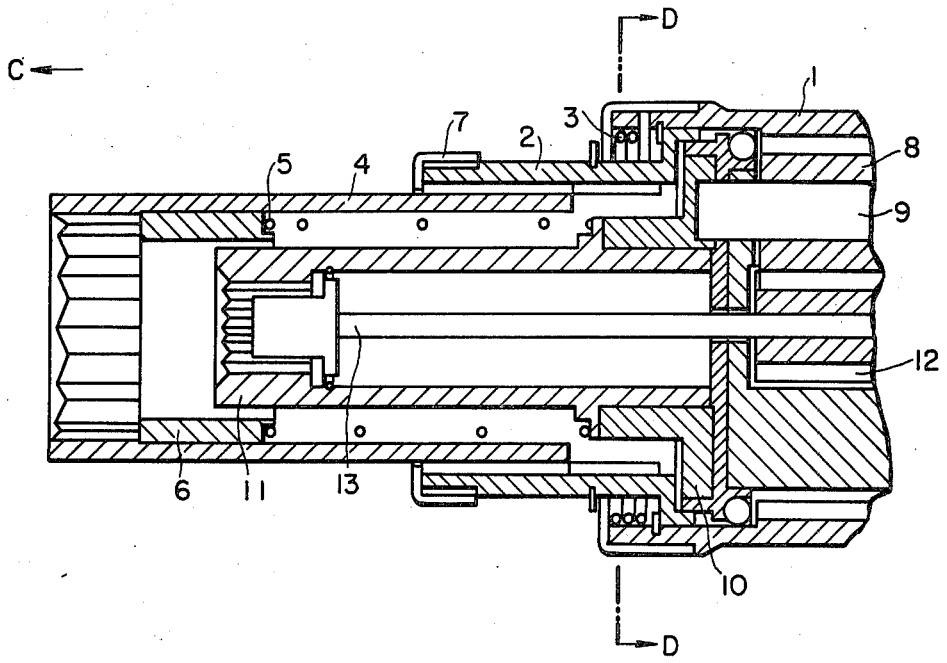
FIG. 1 is a fragmentary longitudinal cross-sectional view of a bolt fastening tool according to the present invention.
Figure 2:
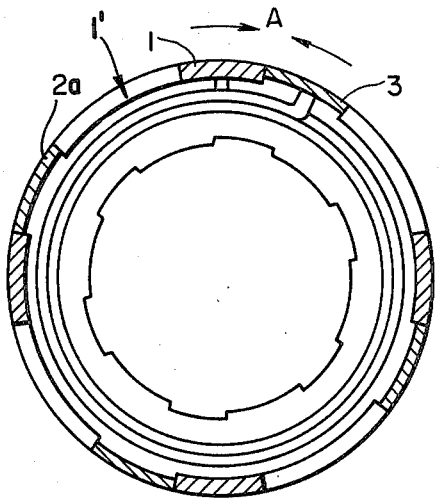
FIG. 2 is a cross-sectional view taken along the line D—D of FIG. 1, showing the parts as positioned just before the tool is actuated.
Figure 3:
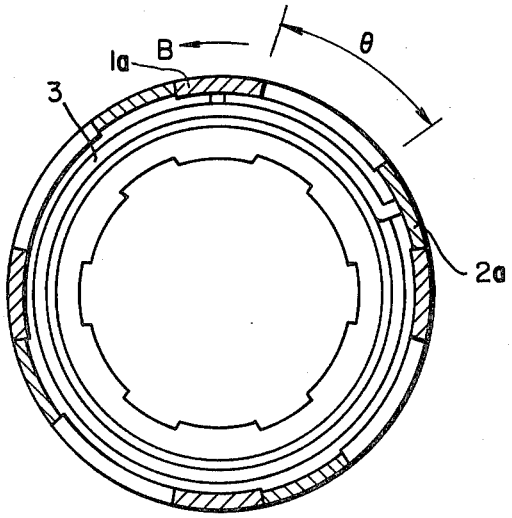
FIG. 3 is a cross-sectional view similar to FIG. 2, showing the parts as position just before the tool starts tightening a bolt.

As shown in FIG. 1, a bolt fastening tool or a shearing wrench comprises a planetary gear mechanism including an internal gear 1 in which there is fitted an outer socket holder 2. Internal gear 1, as illustrated in FIGS. 1 and 2, includes plural circumferentially spaced elements 1*a* peripherally formed facing outer socket holder 2. The holder 2 includes corresponding plural, circumferentially spaced elements 2*a* (FIGS. 2 and 3) which respectively interfit between elements 1*a* to define annular gaps 1′ permitting relative rotational movement of the internal gear until the elements 1*a* travel through gaps 1′ into contact with elements 2*a* to rotate holder 2. Internal gear 1 and outer socket holder 2 are normally urged relative to each other in the circumferential directions indicated by arrows A (FIG. 2) by means of a torsion spring 3 acting therebetween. A cylindrical outer socket 4 is telescopically and corotatably fitted in outer socket holder 2 and normally urged in the axial direction indicated by arrow C to move out of holder 2 by a compression coil spring 5 held at one end against a sleeve 6 mounted in outer socket 4. Outer socket holder 2 has an annular stop 7 screwed thereto to prevent outer socket 4 from being axially displaced off the outer socket holder in the direction of arrow C.

The planetary gear mechanism includes a plurality of planet gears 8 (one shown in FIG. 1) each rotatably supported on a shaft 9 and held in mesh with internal gear 1. The shaft 9 is secured to an inner socket holder 10 for corotation, the inner socket holder being coaxially housed in outer socket holder 2. Inner socket holder 10 supports a cylindrical inner socket 11 fixed thereto that extends coaxially within outer socket 4. The other end of spring 5 is held against a shoulder of inner socket 11 as illustrated in FIG. 1. Planet gears 8 are in mesh with a sun gear or a pinion 12 coupled to an electric motor (not shown). An ejector rod 13 extends axially through inner socket 11 and has one end projecting through pinion 12.

The bolt fastening tool thus constructed will operate as follows: When the motor is energized, a fastening torque is transmitted from pinion 12 to both outer socket 4 through internal gear 1 and inner socket 11 through shafts 9 of planet gears 8.

The internal gear 1 and outer socket holder 2 are initially urged into the position of FIG. 2 by torsion spring 3. While the outer and inner sockets 4, 11 fit respectively over the head and tip of a bolt (not shown) to be fastened, internal gear 1 is caused to angularly move through an angle $\theta$ (FIG. 3) in the direction of the arrow B. At this time, no torque is transmitted to outer socket holder 2. When internal gear 1 engages outer socket holder 2 in the position illustrated in FIG. 3, a fastening torque starts being applied to outer socket 4 to fasten the bolt.

When the tip of the bolt shears off, only inner socket 11 is caused to rotate while permitting planet gears 8 to revolve in mesh with internal gear 1, which is prevented from being rotated. After the bolt is thus fastened, outer socket 4 is pulled out of engagement with the bolt head, whereupon internal gear 1 and outer socket holder 2 resume the position of FIG. 2 under the resiliency of torsion spring 3. Thus, torsion spring 3 constitutes a lost-motion connection between internal gear 1 and socket holder 2.

With the arrangement of the present invention, the internal gear 1 is allowed to angularly move through angle $\theta$ before the bolt starts being fastened. Therefore, the time interval required for internal gear 1 to turn relative to socket holder 4 is available for the outer socket 4 and inner socket 11 to fit completely over the bolt head and tip without being subjected to a fastening torque.

Although a certain preferred embodiment has been described in detail, it should be understood that many changes and modifications may be made therein without departing from the scope of the appended claims.

What is claimed is:

1. A fastening tool for fastening a bolt having a shearable tip, comprising:

(a) a planetary gear mechanism including an internal gear, planetary gears having shafts and held in mesh with said internal gear, and a drivable sun gear held in mesh with said planetary gears;

(b) an outer socket coupled to said internal gear for fitting engagement with the bolt;

(c) an inner socket disposed coaxially within said outer socket and coupled to said planetary gear shafts for fitting engagement with the tip of the bolt; and (d) said planetary gear and said outer and inner sockets jointly providing a torque transmitting mechanism including a spring-biased lost-motion connection preventing a fastening torque from said sun gear from being transmitted to the outer socket until said planetary gears turn for a limited angular interval, wherein said lost motion connection includes a torsion spring connected between said internal gear and said outer socket to allow said internal gear to rotate with respect to said outer socket for said limited angular interval before imparting a fastening torque to the outer socket and wherein said internal gear includes plural circumferentially spaced elements interfitting with corresponding circumferentially spaced elements formed on an outer socket holder connected to the outer socket, rotation of the elements on the internal gear against the bias of said torsion spring into contact with said elements on the outer socket holder thereby causing delayed rotation of the outer socket.

* * * * *